US007063512B2

(12) United States Patent
Haesloop et al.

(10) Patent No.: US 7,063,512 B2
(45) Date of Patent: Jun. 20, 2006

(54) PUMP STABILIZER AND METHOD

(75) Inventors: William G. Haesloop, Las Vegas, NV (US); Motoyasu Ogawa, Saitama (JP)

(73) Assignee: Nikkiso Company, Ltd. (JP)

( * ) Notice: Subject to any disclaimer, the term of this patent is extended or adjusted under 35 U.S.C. 154(b) by 393 days.

(21) Appl. No.: 10/604,021

(22) Filed: Jun. 23, 2003

(65) Prior Publication Data

US 2004/0037721 A1 Feb. 26, 2004

Related U.S. Application Data

(60) Provisional application No. 60/390,770, filed on Jun. 21, 2002.

(51) Int. Cl.
*F04B 3/00* (2006.01)

(52) U.S. Cl. ..... 417/244; 417/359; 417/361; 417/365; 417/572; 384/627

(58) Field of Classification Search ..... 417/244, 417/359, 361, 365, 572; 384/627
See application file for complete search history.

(56) References Cited

U.S. PATENT DOCUMENTS 4,276,002 A * 6/1981 Anderson ..... 417/405
4,345,884 A * 8/1982 Longiny et al. ..... 417/359

* cited by examiner

*Primary Examiner*—Charles G. Freay
*Assistant Examiner*—Ryan Gillan
(74) *Attorney, Agent, or Firm*—Cantor Colburn LLP

(57) ABSTRACT

A vertically-disposed pump shaft is supported by an upward force against the pump shaft during periods of non use of the pump thereby off-loading bearings normally supportive of the shaft to prevent damage thereto when the pump is moved. Additionally, a lateral support is provided at a lower end of the pump to prevent lateral movement while permitting axial movement, thereby reducing stresses against the pump housing and other components.

15 Claims, 4 Drawing Sheets

PUMP STABILIZER AND METHOD

CROSS REFERENCE TO RELATED APPLICATIONS

This application claims priority to provisional U.S. patent application Ser. No. 60/390,770 filed on Jun. 21, 2002, incorporated herein by reference in its entirety.

BACKGROUND

The present disclosure relates to a system and method for supporting large vertically-oriented pumps. More particularly, this disclosure relates to a system and method for vertically supporting a pump and for relieving stress against pump shaft bearings during periods of non-use in a dynamic environment such as the deck of a ship.

To transfer fluids between containers or from one container to a point of use, reciprocating or centrifugal-type mechanical pumps are often employed. Industrial centrifugal pumps consist of a vertically extending column having an intake, and one or more stages of impellers mounted about a shaft at the lower end of the column. The impellers are driven by the shaft, which extends coaxially upward through the column to a drive motor mounted on top of a discharge head, which is mounted on top of the vertical column. During operation, the pump intake is located at the bottom of the pump and is submerged into the pumped liquid or is fed pressurized liquid from one or more feeder pumps. Rotation of the impellers causes the liquid to be drawn into the pump intake delivered to an outlet conduit in fluid communication with another container, conduit, or point of use.

Depending on the particular application, these types of pumps may be of substantial size with typical column lengths of about 15 to about 20 feet (about 4.5 to about 6 meters) or more, and column diameters ranging up to about 3 feet (about 1 meter) or more. The pump is thus made up of several major components, each of which may weigh several hundred pounds, wherein the total weight of the pump can be in excess of about 10,000 to about 15,000 pounds (about 4,500 to about 6,800 kilograms) or more.

As described above, such pumps are generally mounted on a fixed base such that there is little or no movement of the support base while the pump is operating. However, occasionally pumps are mounted on bases that are subject to motion (both during operation and during periods of non-operation of the pump). For example, when the pump is mounted on the deck of a ship, where the ship cants from side to side or comes down hard over the top of a wave. Such motion can impart significant accelerations against the pump and its components—potentially having a G-force of up to about 1.8 G when added to the normal force of gravity. These forces can cause brinneling of the bearings, which significantly reduces bearing life.

In addition, pumps are not currently adequately supported to withstand side-to-side motion or canting of the pump support either during use or periods of non-use.

BRIEF SUMMARY

These and other problems and deficiencies of the prior art are overcome by providing a pump shaft support and method in which an upward force is exerted against the pump shaft during said periods of non-use of the pump thereby off-loading bearings normally supportive of the shaft. In another embodiment, a vertically oriented pressure pot having a cap secured thereto at an upper end thereof has suspended therefrom a pump housing, and a lateral support fixed to a lower end of the pressure pot interacts with an extension of the pump housing to prevent the pump housing from swinging laterally within the pressure pot.

The above described and other features are exemplified by the following figures and detailed description.

BRIEF DESCRIPTION OF THE DRAWINGS

These and other features will be described below with reference to the following figures, in which.

DETAILED DESCRIPTION OF THE PREFERRED EMBODIMENTS

Figure 1:
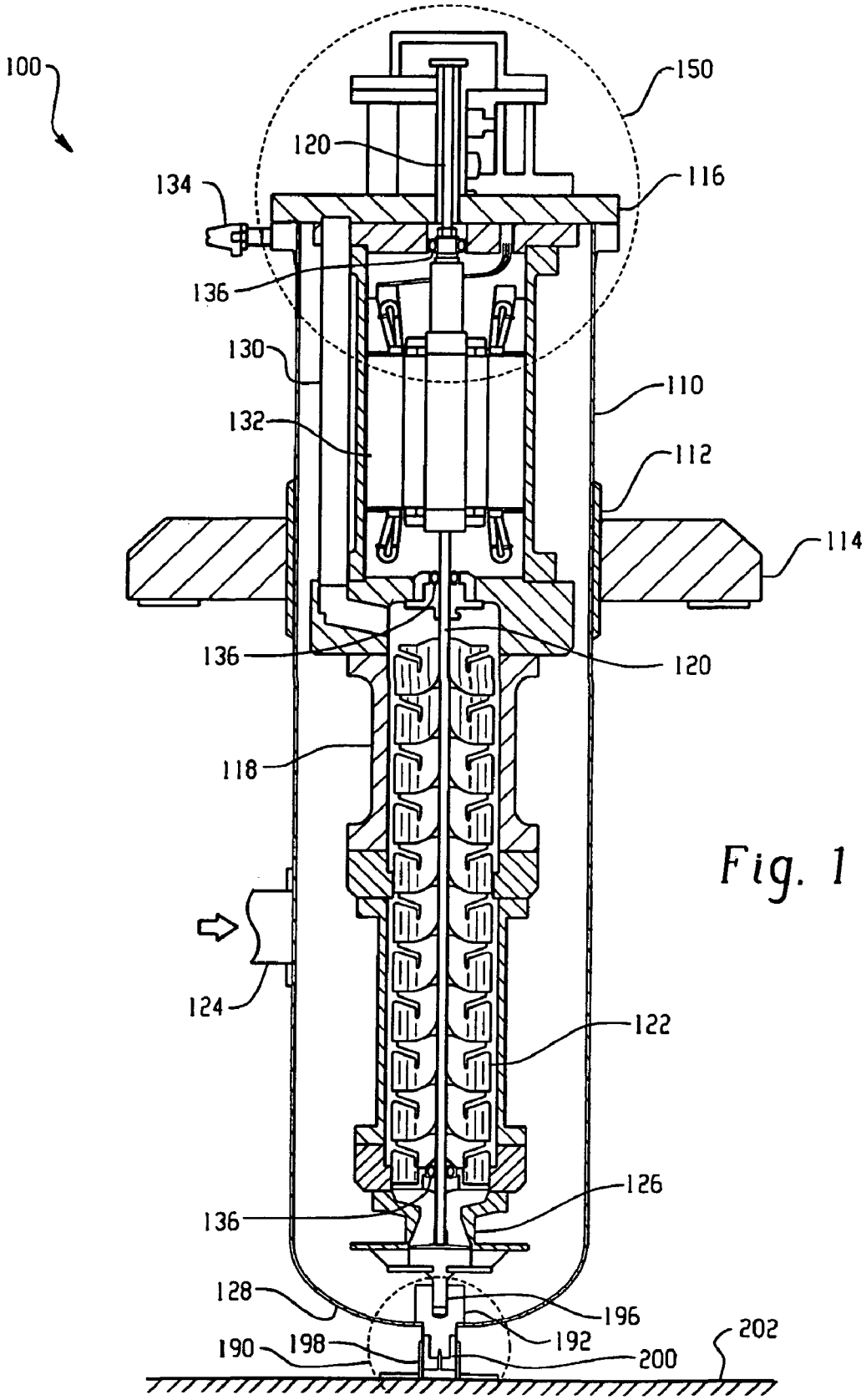
FIG. 1 shows a cross-sectional view of a pump.

Referring now to FIG. 1, a pump 100 includes a suction pot 110 primarily supported by support ring 112 and support arms 114.

Attached to the top of suction pot 110 is a cap 116 from which a pump housing 118 is suspended. Mounted for rotation within pump housing 118 is pump shaft 120, which carries at least one set of vanes 122, which pump the fluid by centripetal force in a known manner. Fluid enters suction pot 110 through intake 124 under pressure from feeder pumps (not shown). The fluid enters pump housing 118 by inlet 126 at about the bottom 128 of suction pot 110, which then passes through one or more sets of the vanes 122, wherein each set of vanes constitutes a stage. At the top of the pumping chambers is an exhaust conduit 130, which passes the fluid to an exhaust outlet (not shown). In this manner, fluid enters from the bottom 128 of the suction pot 110 and is discharged at an upper portion of the suction pot 110 via the exhaust conduit 130. Shaft 120 is driven by electric motor 132 to facilitate movement of the sets of vanes 122 during operation. A vibration sensor 134 is coupled to the suction pot 110 for detecting abnormal vibrations that could indicate a bearing failure or other malfunction.

In certain applications, pump 100 may be subjected to relatively large accelerations that have the potential of putting undue stress on shaft support bearings 136 (three sets shown). To relieve the stress against the shaft support bearings 136, a shaft support system 150 is employed during periods of non-use of pump 100.

Figure 2:
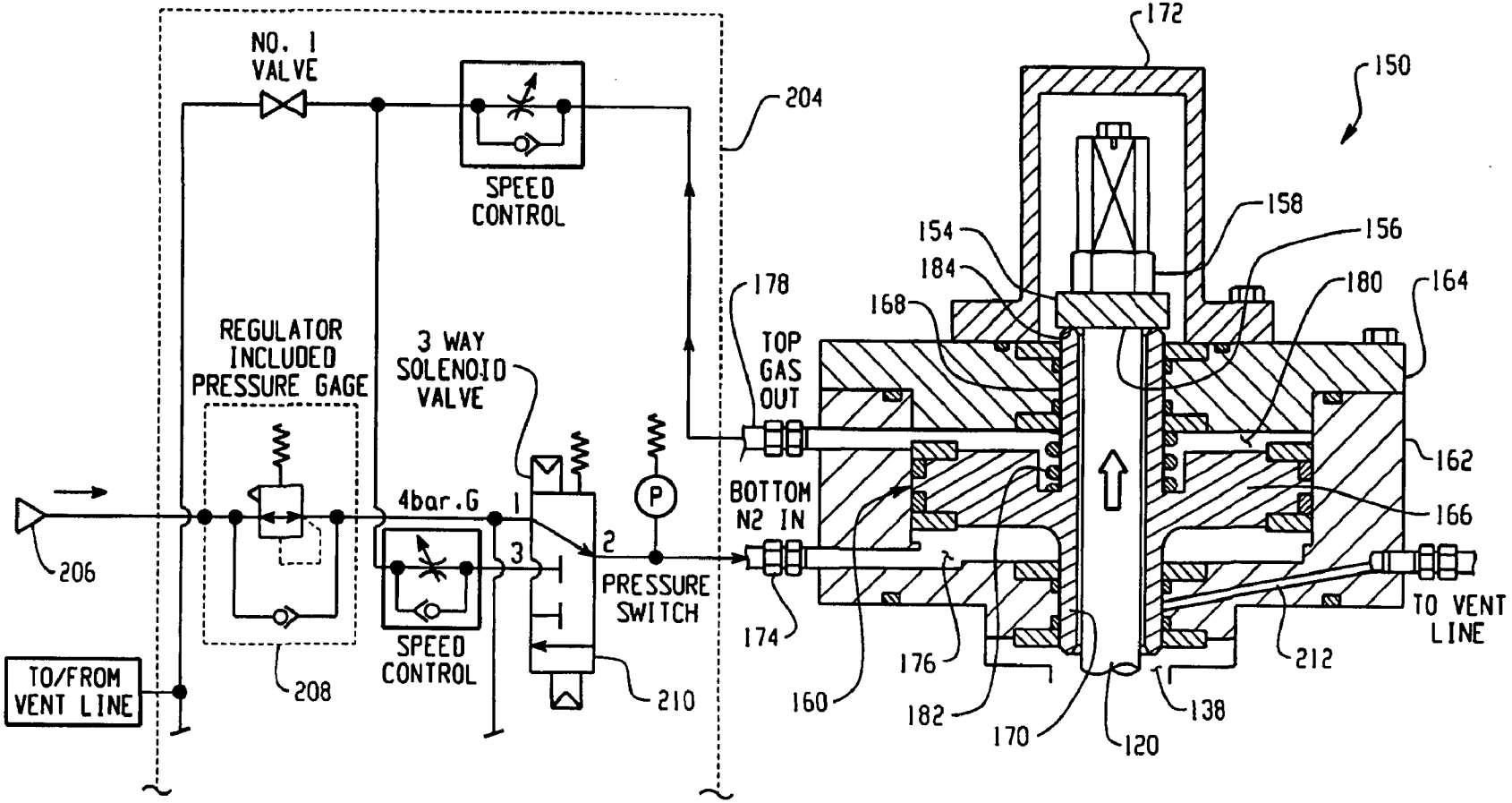
FIG. 2 shows a detail of a pump shaft locking mechanism in an engaged position according to one embodiment.
Figure 3:
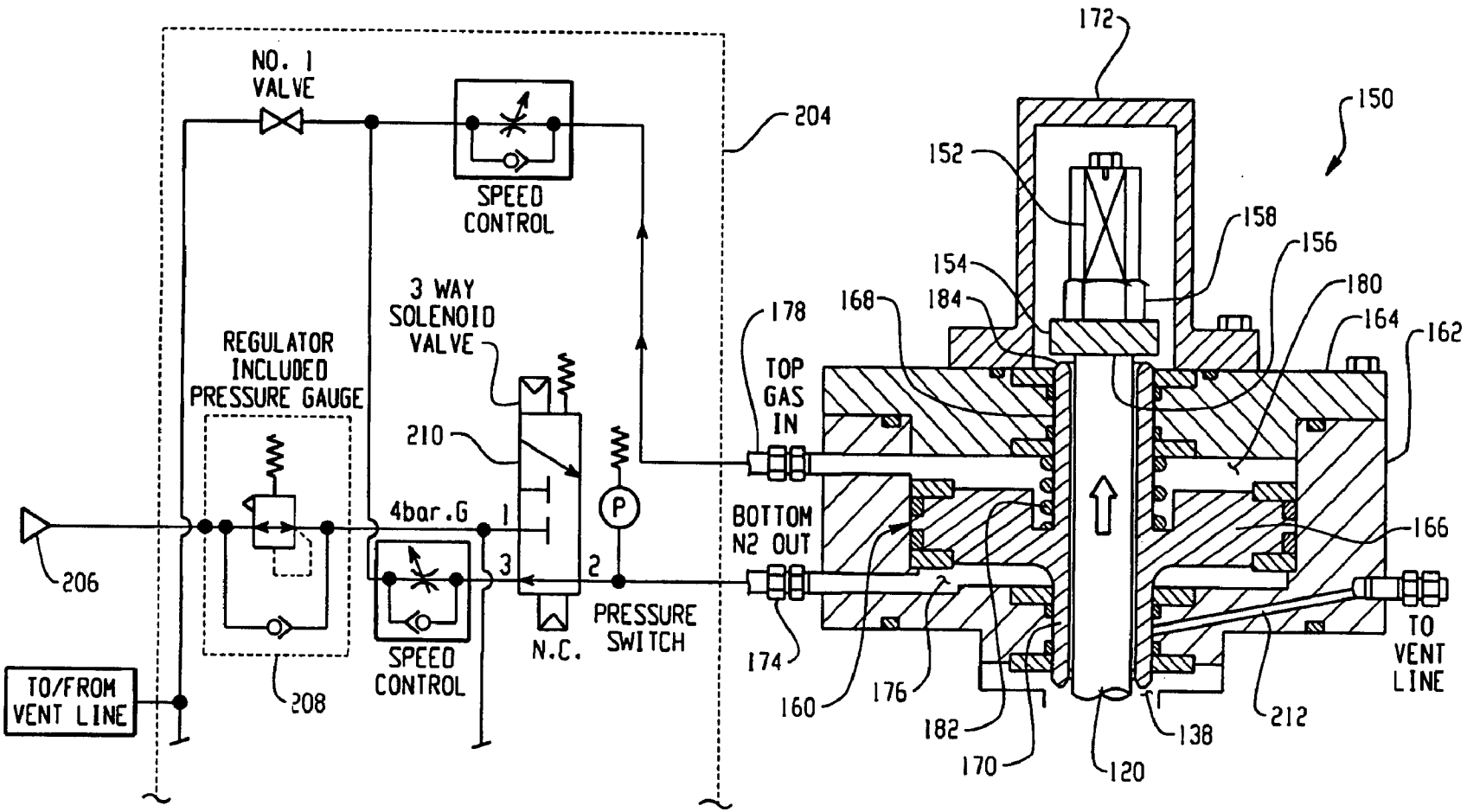
FIG. 3 shows the pump shaft locking mechanism of FIG. 2 in a disengaged position.

FIGS. 2 and 3 illustrate one embodiment of the shaft support system 150 during pump operation and when the pump is not in use, respectively. In the shaft support system 150, it is noted that shaft 120 extends upwardly through an opening 138 (in the cap 116 of suction pot 110 as shown in FIG. 1). A threaded upper end 152 of the shaft 120 includes a washer 154 secured against a shoulder 156 of the threaded upper end 152 by at least one or more nuts 158. Configured about shaft 120 is a cylinder shaped opening 160 (shown generally by arrow 160), which extends between end plates 162 and 164. Each one of the end plates 162, 164 includes an opening through its center through which the pump shaft 120 extends. Disposed between the shaft 120 and within the cylinder shaped opening 160 is an annular piston 166.

Annular piston 166 includes a first stem 168 extending up through the opening formed in end plate 164 and a second stem 170 extending down through the opening formed in end plate 162. The annular piston 166 is preferably sealed against an inner wall of the cylinder 160, and an inner wall of the openings formed in end plates 162, 164. End plate 162 is further sealed to cap 116 (FIG. 1) of the suction pot 110, and end plate 164 is further sealed to cap 172, which covers the threaded upper end 152 of the pump shaft 120.

End plate 162 further includes an inlet 174 in fluid communication with a pressure space 176 formed between the annular piston 166 and end plate 164. In addition, end plate 162 includes inlet 178 that is in fluid communication with a pressure space 180 formed between piston 166 and end plate 162. A compression spring 182 is disposed in pressure space 180 for biasing the annular piston 166 towards end plate 162.

As shown in FIG. 3, during periods of non-use of pump 100, pressurized fluid, e.g., nitrogen, is supplied to inlet 174, causing the fluid pressure within pressure space 176 to increase. Inlet 178 is connected to a low-pressure source, such as atmospheric pressure. When the pressure differential between pressure spaces 176 and 180 overcomes the forces exerted by compression spring 182, the annular piston 166 moves in an upward direction causing rim 184 of the first stem 168 to move and contact washer 154. Pressure within pressure space 176 may be regulated to a predetermined amount of pressure using a control system 204, thereby applying a predetermined amount of force against washer 154. Sufficient force is thereby exerted against washer 154 to off-load bearings 136 (see FIG. 1) from the weight of shaft 120 and vanes 122 carried thereon, thereby protecting bearings 136 from brinneling due to overloading such as may be caused by movement of the support system 150, for example.

The control system 204 as shown generally includes a gas source 206 in fluid communication with a pressure regulator 208 and an actuatable valve 210 such as a solenoid valve. Circuitry means are provided for actuating the valve and controlling the pressure. In this manner, the control system 204 can be used to engage and disengage the shaft support system 150 during use and on-use of the pump 100.

An optional vent 212 is preferably disposed in fluid communication with a space defined between the second stem 170 and wall of the end plate 162 as shown. The vent prevents fluid from being mixed with the actuating gas 206 of the shaft support system 150. Mixture of the actuating gas and the fluid being pumped is prevented even in the event of seal failure.

Among the advantages of the shaft support system 150 shown in FIG. 2 is that support of the shaft 120 can be automatically operated and engaged when the pump 100 is shut down. In addition, support of the shaft 120 can be disengaged on demand when the pump 100 is started or activated. An interlocking mechanism comprising a pressure switch in operative communication with pressure space 176 is preferably used to prevent operation of pump 100 when support of the shaft 120 is engaged, thereby preventing damage to the various components of the support system 150 and pump 100. In addition, by using pneumatic pressure in compression space 176, the annular piston 166 automatically compensates for thermal variances resulting from the materials used for the shaft 120 and the pump housing 118. For example, the shaft 120 is preferably fabricated from stainless steel. In contrast, the pump housing 118 is preferably fabricated from aluminum. When pump 100 is used for pumping cryogenic fluids, the stainless steel shaft 120 and the aluminum pump housing 118 will react differently due to their differing thermal coefficients of expansion. The support system 150 advantageously maintains a relatively constant lifting force against the threaded upper end 152 of the pump shaft 120 during the period of non-use. For example, after pumping cryogenic fluid such as liquefied hydrogen, liquefied nitrogen, liquefied natural gas, or other cryogenic fluids having a temperature of between 0Â° K to 125Â° K or more the pump components will be significantly chilled. The shaft support system 150 as described herein can be engaged, if desired, at these temperatures and remain engaged after the pump warms up during the period of non-use.

Figure 4:
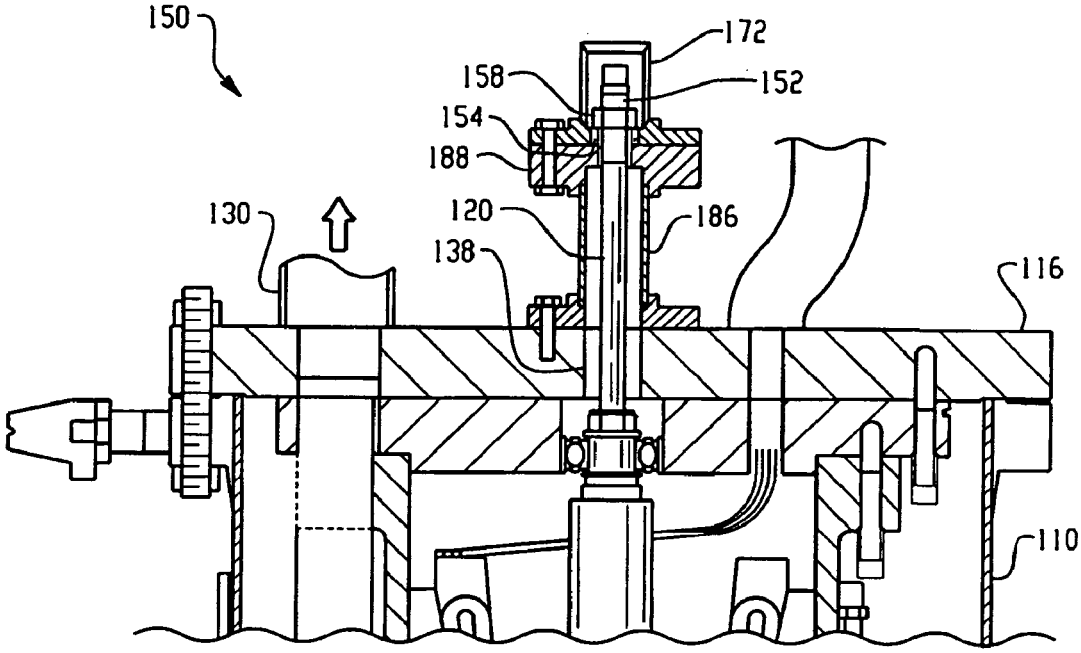
FIG. 4 shows a detail of a pump shaft locking mechanism according to a second embodiment.

FIG. 4 shows a second embodiment of shaft support system 150 that provides a simpler design than the embodiment of FIGS. 2 and 3. In this embodiment, the shaft support system 150 is manually operated. Shaft 120 extends upward through hole opening 138 in cap 116 of suction pot 110. A support 186 supports platform 188, which includes an opening through which the threaded upper end 152 of the pump shaft 120 passes therethrough. During periods of non-use of pump 100, a nut 158 is threaded over upper end 152 of shaft 120 to a predetermined torque, thereby relieving bearings 136 of excess stress generated during movement of the support structure for pump 100. When the pump is to be used, nut 158 is removed completely and cap 172 is placed over the upper end of the shaft 120.

Figure 5:
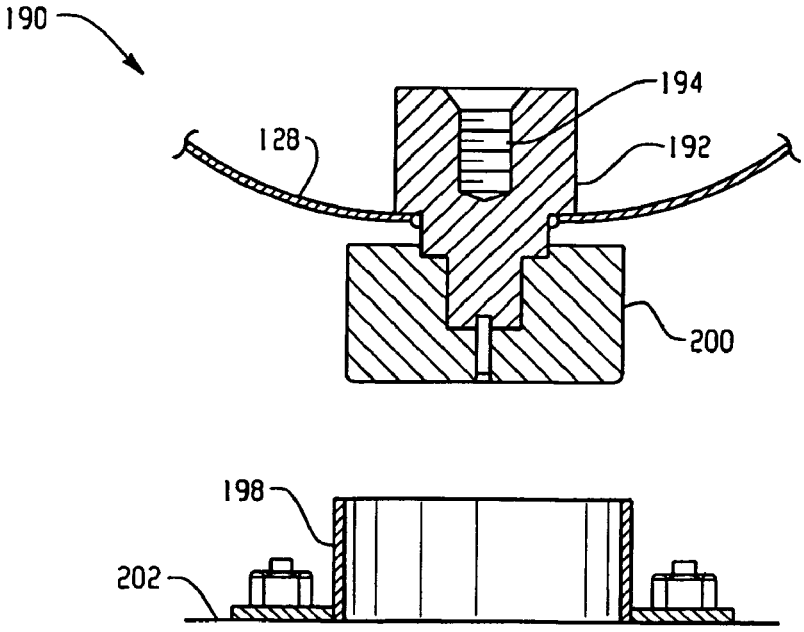
FIG. 5 shows a partially exploded view of a lateral support.

Referring again to FIG. 1, it is noted that the primary support for suction pot 110 is by support ring 112 and support arms 114. The pump housing 118 is suspended entirely from cap 116 of suction pot 110. Thus, when subjected to lateral forces such as canting of a ship or other structure on which pump 100 is disposed, tremendous stresses occur against suction pot 110 and pump housing 118 due to induced lateral movement thereof. To reduce or eliminate such lateral movement, a lateral support 190 is provided at a lower end of suction pot 110. As shown more clearly in FIG. 5, the lateral support 190 of the pump 100 comprises a holder 192 extending through and welded to the bottom 112 of suction pot 110. Holder 192 includes a recess 194 into which a post 196 depends. Post 196 is fixedly coupled to a lower end of the pump located distal to vanes 122. The post 196 (FIG. 1) and recess 194 cooperate to prevent relative lateral movement therebetween. A thermal block 200 is preferably disposed at a lower end of holder 194, which extends into a cup 198. Cup 198 is secured to a rigid support surface 202 external to the pump 100, which may comprise the bottom of the chamber (not shown) housing the pump 100 or another support surface available. Thus, cup 198 and thermal block 200 cooperate to prevent lateral movement of the suction pot 110.

This configuration is particularly advantageous for pumping cryogenic fluids such as liquefied hydrogen, nitrogen, natural gas or other such low temperature liquids in the range of 0Â° K to 125Â° K or more. As previously discussed, shaft 120 and suction pot 110 are preferably formed of stainless steel (e.g., 316 stainless steel) whereas pump housing 118 is preferably formed of aluminum. Since aluminum has a greater thermal expansion coefficient than stainless steel, it is expected that the lower end of pump housing 118 will move with respect to the bottom 128 of the suction pot 110. Furthermore, as temperatures change it is expected that the bottom 128 of the suction pot 110 will move with respect to surface 202. The recess 194 and cup 198 preferably have a sufficient depth to permit relative motion between the post 196, the holder 192, and cup 198 to allow thermal expansion yet at the same time prohibit substantial lateral movement. Thermal block 202 is preferably formed of a high strength structural material that has thermal insulative properties to prevent heat from surface 202 and cup 198 from being conducted through to the interior of suction pot 110 by holder 192. If pump 100 is not intended to be used for cryogenic fluids, thermal block 200 may not be required or may be incorporated into holder 192 as a single element depending on the thermal properties of the fluid.

While the disclosure has been described with reference to a preferred embodiment, it will be understood by those skilled in the art that various changes may be made and equivalents may be substituted for elements thereof without departing from the scope of the disclosure. Terms such as first and second as used herein are not intended to imply an order of importance or location, but merely to distinguish between one element and another of like kind. In addition, many modifications may be made to adapt a particular situation or material to the teachings of the disclosure without departing from the essential scope thereof. Therefore, it is intended that the disclosure not be to the particular embodiment disclosed as the best mode contemplated for carrying out this disclosure, but that the disclosure will include all embodiments falling within the scope of the appended claims.

What is claimed is:

1. A rotating machine comprising:

a vertically-mounted shaft supported in a main housing, said shaft being normally supported by bearings within said housing and said shaft having an upper end extending through an upper end of said main housing;

a movable shaft support for relieving said bearings of stress during periods of non use of said rotating machine, said shaft support providing an upward force on said shaft.

2. The rotating machine of claim 1, wherein said rotating machine is a pump.

3. The rotating machine of claim 1, wherein said shaft support comprises a pneumatic piston which converts fluid pressure into a force exerted upward against said upper end of said shaft.

4. The rotating machine of claim 1, wherein said upper end of said shaft is threaded and said shaft support comprises a platform having an opening through which said upper end passes and a nut tightened over said upper end and onto said platform, said nut thereby imparting an upward force on said upper end of said shaft.

5. A pump comprising:

a pump housing, said pump housing being oriented vertically;

a shaft, said shaft being supported for rotation on bearings within said pump housing;

a movable shaft support for selectively relieving said bearings of stress during periods of non-use of said pump, said shaft support providing an upward force on said shaft.

6. The pump of claim 5, wherein said shaft support provides an upward force on an upper end of said shaft.

7. The pump of claim 6, wherein said upper end of said shaft extends through an upper end of said pump housing.

8. The pump of claim 7, wherein said upper end of said shaft is threaded and said shaft support comprises a platform having a hole through which said upper end of said shaft passes and a nut tightened over said upper end of said shaft and onto said platform, said nut thereby imparting an upward force on said upper end of said shaft.

9. The pump of claim 5, wherein said shaft support comprises a pneumatic piston which converts fluid pressure into a force exerted upward against an upper end of said shaft.

10. The pump of claim 9, further comprising a control system, wherein the control system comprises a gas source in fluid communication with the pneumatic piston and an actuatable valve intermediate the gas source and the pneumatic piston.

11. The pump of claim 9, wherein said piston is coaxially disposed over said upper end of said shaft, said piston having a tubular stem extending therefrom, said tubular stem engaging said upper end of said shaft when a pressure space directly beneath said piston is pressurized relative to a pressure space over said piston, said piston and said stem thereby imparting an upward force against said upper end of said shaft.

12. The pump of claim 10, further comprising a vent in fluid communication with a space defined by a wall of the support system in contact with the pneumatic piston.

13. A method of supporting a pump shaft during periods of non-operation of a pump, said method comprising:

selectively exerting an upward force against said shaft during said periods of non use thereby off-loading bearings normally supportive of said shaft.

14. The method of claim 13, wherein said step of exerting an upward force comprises charging a pressure space below a pneumatic piston with pressurized fluid.

15. The method of claim 13, wherein said step of exerting an upward force comprises tightening a nut over a threaded upper end of said shaft and against a platform supported above said pump.

* * * * *